US006337537B1

(12) United States Patent
Bourgade et al.

(10) Patent No.: US 6,337,537 B1
(45) Date of Patent: Jan. 8, 2002

(54) VACUUM DIODE WITH HIGH SATURATION CURRENT DENSITY AND QUICK RESPONSE TIME FOR DETECTING OF ELECTROMAGNETIC RADIATION

(75) Inventors: Jean-Luc Bourgade, Antony; Dominique Gontier, Melun, both of (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/381,271

(22) PCT Filed: Mar. 20, 1998

(86) PCT No.: PCT/FR98/00564

§ 371 Date: Oct. 19, 1999

§ 102(e) Date: Oct. 19, 1999

(87) PCT Pub. No.: WO98/43275

PCT Pub. Date: Oct. 1, 1998

(30) Foreign Application Priority Data

Mar. 21, 1997 (FR) ..... 97 03476

(51) Int. Cl.[7] ..... H01J 40/00

(52) U.S. Cl. ..... 313/539; 313/534; 313/542; 313/544; 313/495; 313/497; 313/359.1; 313/360.1; 313/356; 324/244; 324/258

(58) Field of Search ..... 313/539, 534, 313/542, 544, 356, 529, 495, 497, 523, 359.1, 360.1; 324/258, 244, 121 R

(56) References Cited

U.S. PATENT DOCUMENTS

| | | | | |
|---|---|---|---|---|
| 3,983,437 A | | 9/1976 | Benson et al. | 313/99 |
| 4,358,764 A | * | 11/1982 | Cheal et al. | 343/5 |
| 5,245,183 A | * | 9/1993 | Anderson et al. | 250/239 |

FOREIGN PATENT DOCUMENTS

| | | |
|---|---|---|
| DE | 32 38 387 | 4/1984 |
| FR | 699 787 | 2/1931 |
| RU | 2120706 | * 10/1998 |

OTHER PUBLICATIONS

C.J. Armentrout, et al., Review of Scientific Instruments, vol. 59, No. 8, pps. 1843–1845, "UV to Soft–X–Ray Surveys Using a Compact, Biplanar Diode Array," Aug. 1, 1988.

E.L. Nichols, et al., The Physical Review, vol. 32, No. 5, pps. 492–511, "Discharge from Hot CaO," May 1911.

I. Langmuir, The Physical Review, vol. 2, No. 6, pps. 450–486, "The Effect of Space Charge and Residual Gases on Thermionic Currents Highs Vacuum," Dec. 1913.

I. Langmuir, The Physical Review, vol. 21, No. 4, pps. 419–435, "The Effect of Space Charge and Initial Velocities on the Potential Distribution and Thermionic Current Between Parallel Plane Electrodes," Apr. 1923.

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A vacuum diode with a high saturation current density and a rapid response time for the detection of electromagnetic radiation.

This diode comprises a grid (6) in the shape of a cylinder and a photo-cathode (4) which extends along the axis (X) of the cylinder. The photo-cathode includes a part of the internal conductor of a coaxial cable (8), the external conductor and the electrically insulating material of the coaxial cable being removed opposite this part, and the grid is electrically connected to the external conductor of this coaxial cable, the internal and external conductors being coaxial.

Application to the detection of visible, infra-red, ultra-violet and X radiation.

4 Claims, 1 Drawing Sheet

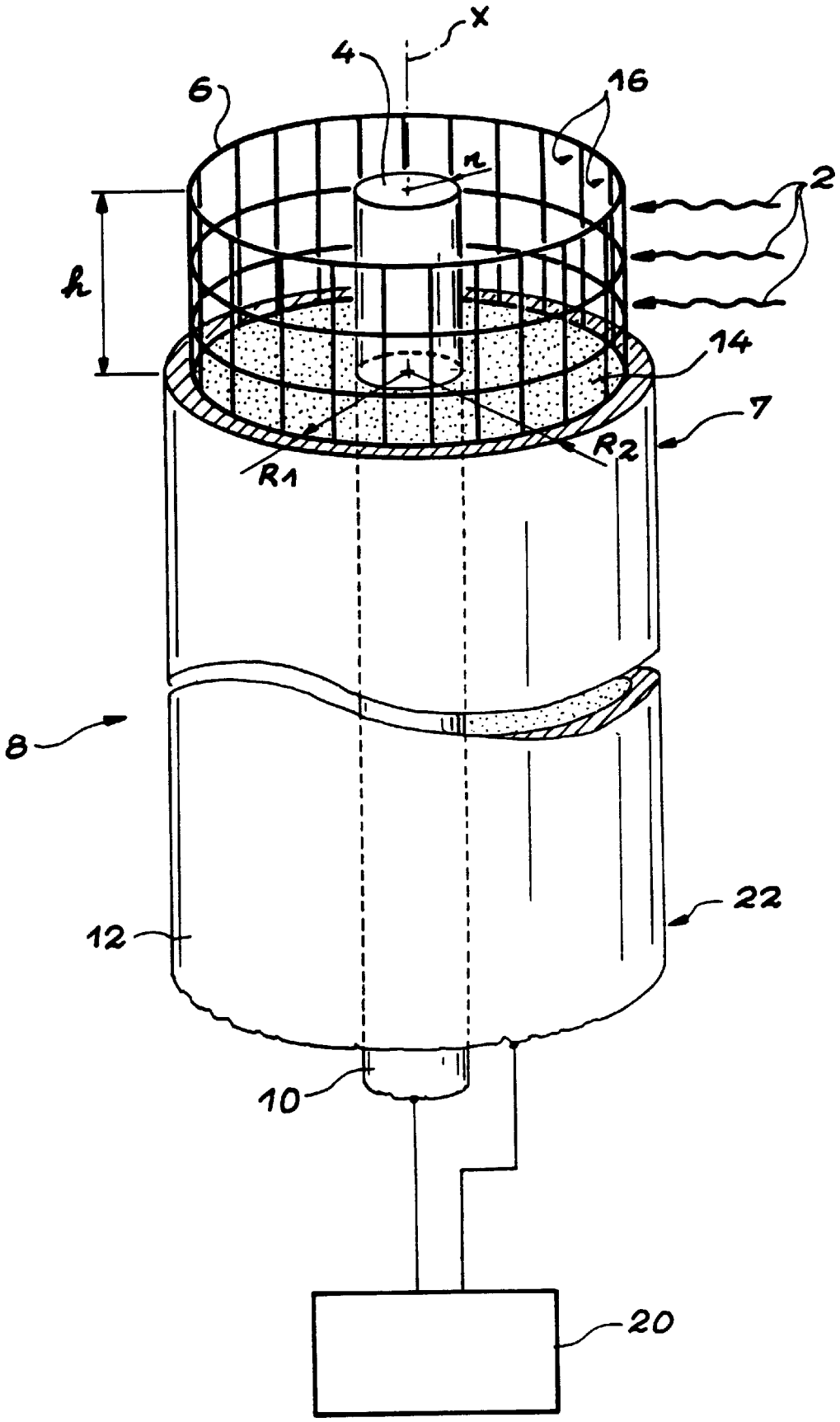
X
4
6
16
r
2
h
14
7
R1
R2
8
22
12
10
20

VACUUM DIODE WITH HIGH SATURATION CURRENT DENSITY AND QUICK RESPONSE TIME FOR DETECTING OF ELECTROMAGNETIC RADIATION

TECHNOLOGICAL FIELD

This invention relates to a vacuum diode with a high saturation current density and a rapid response time for the detection of electromagnetic radiation.

It particularly finds applications in the field of detection of infra-red, visible, ultra-violet and X radiation.

In particular, the invention can be used in a broad band spectrometer, which is used to measure the spectrum of X-radiation emitted by a plasma generated by means of a laser.

It is concerned with improving the temporal and spectral resolution of such a spectrometer and also to reducing the volume it occupies.

It is desirable to have available an X-ray detector capable of accepting a high flux of this radiation and which at the same time has good temporal response.

STATE OF THE PRIOR ART

One is lead to seek a radiation detector which permits:

on the one hand to have the highest saturation current density possible in order to be able to accept a high photon flux and to place this detector as near as possible to the emitting plasma so as to reduce the volume of the spectrometer, on the other hand to obtain a better temporal response than that provided by the detectors (vacuum diodes) that are normally used in such a spectrometer, a temporal response of about 150 ps.

Detectors using photo-conductors have such properties in principle but their calibration, in terms of reliability and stability is more delicate to obtain compared with that of traditional vacuum diodes.

This is the reason why, in this invention, a photo-cathode subjected to X radiation is preferred, a photo-cathode whose X ray yield is well known quantitatively and is stable over time.

Furthermore, over the past few years, the range of coaxial cables that can be used in experiments creating plasmas by laser irradiation has considerably widened.

The band width of these coaxial cables has therefore changed from a few gigahertz to a few tens of gigahertz and their response times have changed from about a hundred picoseconds to about ten picoseconds.

To measure the spectrum of the X-radiation emitted by a plasma generated by means of a laser, a coaxial cable of the SMA, 50 Ω type can be used, the band width of which is satisfactory (it is about ten gigahertz).

However, for the detection of X-radiation, it is advisable to associate with it a vacuum diode whose configuration is the most suitable possible.

The coaxial cable mentioned above has a diameter of a few millimeters.

This has lead to a search for a vacuum diode having electrodes with small dimensions.

Known vacuum diodes have electrodes, namely a photo-cathode and a grid, which are flat, parallel and positioned facing one another.

Under these conditions, the relevant surface area of the electrodes is perfectly defined, which simplifies the calculation of the absolute response of these diodes but also fixes the maximum current which can be supplied by them.

For such a vacuum diode, the saturation current density through the space charge effect is given by the classic Child formula;

$$(a)\ J=2.34\times10^{-6}V^{1.5}d^{-2}.$$

In this formula:

J represents this current density per unit of surface area, expressed in $A/cm^2$, V represents the voltage between the electrodes of the vacuum diode, expressed in V, and d represents the distance between these electrodes, expressed in cm.

On this subject, one can, for example consult the following document:

(1) Physical Review, vol.5, No.5, 1911, p. 492.

This formula (a) leads very quickly to an important current restriction, if one tries to reduce the surface area of the vacuum diode.

The voltage and the distance between the electrodes are fixed by physical considerations of behavior under voltage, due to the dielectric resistance of a coaxial cable of the kind mentioned above and the level of vacuum for the distance between the electrodes.

Under the normal vacuum conditions for the experiments mentioned above and the static voltage behavior of SMA coaxial cables, the tension is of the order of 1500 V and the distance between the electrodes is of the order of 1 mm, which leads to a limiting current density of the order of 13 $A/cm^2$.

For a diode surface area of 1 $mm^2$, this leads to a maximum current of 0.13 A or with a coaxial cable of the SMA 50 Ω type, to a maximum voltage signal of 6.5 V.

Furthermore, for reasons of reliability of the measurement in terms of linearity of the response of the vacuum diode (voltage response and time response), it is advisable to limit the maximum useful current for a measurement, to a tenth of this value or 0.65 V.

This last value is particularly low, which inevitably leads to a lowering of the measurement dynamic (in this case of the order of 10) since the minimum measurable sensitivity, taking account of the measurement noise, is of the order of 50 mV with a fast oscilloscope for example of the IN 7000 type.

The requirement to limit the maximum current, for a measurement, to a tenth of the saturation current leads one to search for an increase in this latter figure in order to improve the utilization ranges of vacuum diodes for X-rays in terms of linearity within the time domain and level of voltage.

DESCRIPTION OF THE INVENTION

The purpose of this invention is to resolve the problems above and to propose a vacuum diode with a high saturation current density and a rapid response time for the detection of electromagnetic radiation.

More precisely, the subject of this invention is a vacuum diode for the detection of electromagnetic radiation, this diode comprising:

a photo-cathode intended to receive the radiation, and a grid positioned facing the photo-cathode, spaced apart from it and intended to collect the electrons emitted by the photo-cathode when it receives the radiation, this diode being characterized in that the grid has the shape of a cylinder and surrounds the photo-cathode, the latter extending along the axis of the cylinder, in that the photo-cathode includes a part of the internal conductor of a coaxial cable, the external conductor and the electrically insulating material of this coaxial cable being removed opposite this part, and in that the grid is electrically connected to the external conductor of this coaxial cable, the internal and external conductors being coaxial.

Preferably, said part is one end of the internal conductor of the coaxial cable.

The internal radius of the grid can be about equal to the internal radius of the external conductor of the coaxial cable.

The internal radius of the grid can be chosen in such a way that the impedance of the diode, when it is placed under vacuum, is equal to the surge impedance of the coaxial cable.

This allows one to improve the temporal resolution of the diode.

The coaxial structure of the vacuum diode that is a subject of this invention allows it to have improved performance with regard to the maximum current density compared with known vacuum diodes.

Preferably the core (internal conductor) of a coaxial cable is used as a photo-cathode and the grid intended to collect the electrons generated from the core of the coaxial cable by interaction with the radiation is arranged at the periphery of this coaxial cable.

The calculation of the saturation current density through the space charge effect, in the case of a thermo-electronic emission, for an anode in the shape of a cylinder and a heated cathode, arranged along the axis of this cylinder leads to the following formula:

$$(b)\ J=14.65\times10^{-6}.\beta^{-2}.V^{1.5}.r^{-1}$$

In this formula (b):

J represents this current density per unit of cathode length (this length being expressed in cm), J being expressed in A/cm, V represents the voltage between the anode and the cathode (expressed in V), r represents the radius of the cylinder of the anode (expressed in cm), $\beta^{-2}$ is a corrective term (with no dimensions) which tends towards 1 as the ratio of the radius of the cathode (assumed to be cylindrical) to the radius of the anode tends towards 0.

On this subject reference should be made to the following documents:

(2) Physical Review, Series II, Vol. 2, 1913, p. 450.

(3) Physical Review, Series II, Vol. 21, No. 4, 1923, p. 419.

As one may observe on reading the Table that appears at the end of this description, application of formula (b) to this invention leads to very high values for the current density per unit of surface area, the relevant surface area being that of the photo-cathode, that is to say, a part of the core of a coaxial cable in the preferred embodiment.

Hence, for a SMA coaxial cable of 6.35 mm diameter, polarized at 3000 V, the limiting current density is more than 30 A/cm$^2$, being the limiting current density of a diode with a flat structure.

For cables that are even smaller, this density increases considerably.

Hence, a cable of 3.58 mm diameter leads to a charge current density of 50 A/cm$^2$ and for a cable of 1.19 mm diameter, this reaches a value of the order of 200 A/cm$^2$.

Hence a diode conforming to the invention allows a quasi-constant current to be carried, whatever the diameter of the coaxial cable used and leads to fewer limitations with respect to current density than traditional vacuum diodes with flat electrodes.

BRIEF DESCRIPTION OF THE DRAWING

This invention will be better understood on reading the description of an embodiment example given below which is non-limitative and given for information purposes only. It makes reference to the single appended FIGURE which is a diagrammatic perspective view of a particular embodiment of the vacuum diode that is a subject of this invention.

DETAILED DESCRIPTION OF A PARTICULAR EMBODIMENT

The vacuum diode conforming to the invention, which is diagrammatically represented in perspective in the single appended FIGURE, is intended to detect an electromagnetic radiation 2 which is for example X-radiation.

This diode conforming to the invention comprises:

a photo-cathode 4 which is intended to receive the radiation 2, and a grid 6 which is positioned facing the photo-cathode 4 and spaced apart from the photo-cathode and which is intended to collect the electrons emitted by this photo-cathode 4 when it receives the radiation.

Conforming to this invention, the grid 6 surrounds the photo-cathode 4 and has the shape of a cylinder the axis of which has the reference letter X in the FIGURE.

The photo-cathode 4 also has the shape of a cylinder the axis of which is also the axis X as can be seen in the FIGURE.

In the example shown, the diode is formed at one end 7 of a coaxial cable 8 for example of the SMA type.

This cable comprises an internal conductor 10 of cylindrical shape and an external conductor 12 also of cylindrical shape, the conductors 10 and 12 being coaxial.

In addition, the space between the conductors 10 and 12 is filled with a dielectric material 14.

The coaxial cable also comprises a protective sheath which is not shown in the FIGURE.

As can be seen in this FIGURE, the photo-cathode 4 is constituted by a part of the internal conductor 10 which projects from the end 7 of the coaxial cable.

The grid 6 is a metal sheet of small thickness, pierced by a large number of openings 16.

This sheet, initially of rectangular shape has been curved round to form a cylinder, the height of which is equal to the height of the photo-cathode 4 and the internal radius of which is approximately equal to the internal radius of the external conductor 12 of the coaxial cable 8.

The base of the grid 6 is electrically connected to this external conductor 12.

In the FIGURE, the height of the grid 6 (height of the photo-cathode 4) is marked h, the radius of the photo-cathode is r, while the internal radius and the external radius of the external conductor 12 of the coaxial cable 8 are respectively marked R1 and R2.

In order to form the diode conforming to the invention which is diagrammatically shown in the appended FIGURE, one begins by removing the protective sheath from the coaxial cable 8, at the end of it, over a sufficient height, slightly greater than h.

Then the external conductor and the dielectric 14 are removed over this height h, which makes a part of the core of the coaxial cable visible. This part is intended to constitute the photo-cathode 4.

Next, the grid is cut out in the form of a rectangular sheet which is then shaped into a cylinder of suitable size. The base of this cylinder is fixed to the external conductor 12, at the end 7, for example by soldering.

To use the diode conforming to the invention, diagrammatically shown in the appended FIGURE, a suitable measuring apparatus 20 is connected to the internal conductor 10 and an external conductor 12 of the coaxial cable 8, at the end 22 of it, opposite to the end where the diode is to be found.

The measuring apparatus 20 is intended to set up a suitable electrical voltage between these external and internal conductors and therefore between the photo cathode 4 and the grid 6 of the diode, and to measure the current supplied by the grid 6 when the diode is placed under vacuum (very low pressure, of the order of from $10^{-5}$ Pa to $10^{-3}$ depending on the experiments to be carried out) and the radiation 2 that one wishes to examine is directed towards the diode.

To improve the temporal resolution of the diode, a grid of internal radius can be used that is appropriate to the medium between the grid and the photo-cathode (that is to say the vacuum) so that the impedance of the diode is equal to the surge impedance of the coaxial cable 8.

In this case, the internal radius of the grid can be greater than the external radius of the external conductor 12 of the coaxial cable 8 and an adapter component (not shown) then has to be provided that allows an electrical connection to be made between the grid 6 and the external conductor 12.

Verification of the possibility of passing a large current that is quasi-independent of the dimensions of the diode conforming to the invention has been sought.

To do this, a simulation of the operation of this diode has been carried out taking into account the space charge effects in cylindrical geometry.

The results are shown in the Table which is at the end of this description, for four types of coaxial cable which are available in the standard SMA hyperfrequency at 18 GHz or 20 GHz.

The results relating to these four coaxial cables are respectively given in the four columns of the Table.

In this, $D_2$ represents the external diameter of the external conductor of these coaxial cables, $D_1$ represents the internal diameter of this external conductor, d represents the diameter of the internal conductor of the coaxial cables, Vm represents the maximum polarization voltage of the coaxial cables, S represents the surface area of the part of the coaxial cables which forms the photo-cathode, $J_1$ represents the maximum current density per unit of length, obtained using formula (b), $J_2$ represents the maximum current density per unit of length, obtained using the simulation, $j_1$ represents the maximum current density per unit of surface area, obtained using formula (b) and $j_2$ represents the maximum current density per unit of surface area, obtained using the simulation.

The value of the parameter $\beta^2$ for the coaxial cables being considered is also shown in this Table.

The diodes conforming to the invention, with a coaxial structure, have a low capacity per unit of length (less than 0.1 pF/cm) which leads to response time constants RC that are less than about 10 picoseconds and therefore to temporal resolutions that conform to the measurement needs.

These diodes conforming to the invention can be used within current density and temporal response ranges which are inaccessible with known vacuum diodes.

In addition, they can be used with a large number of electromagnetic radiation types ranging from the infra-red to the hard X-ray area (energy of the order of 10 keV) and even beyond that.

This invention is capable of numerous applications notably in the field of laser metrology.

TABLE

| | | | | |
|---|---|---|---|---|
| $D_2$ (mm) | 6.35 | 3.58 | 2.2 | 1.19 |
| $D_1$ (mm) | 5.309 | 2.985 | 1.676 | 0.940 |
| d (mm) | 1.628 | 0.9195 | 0.511 | 0.287 |
| Vm (V) | 3000 | 1900 | 1500 | 1000 |
| $\beta^2$ | 0.557 | 0.557 | 0.557 | 0.557 |
| S ($cm^2$) | 0.51 | 0.29 | 0.16 | 0.09 |
| $J_1$ (A/cm) | 16.3 | 14.6 | 18.2 | 17.3 |
| $J_2$ (A/cm) | 20 | 18 | 21.5 | 21 |
| $j_1$ ($A/cm^2$) | 32 | 51 | 113 | 196 |
| $j_2$ ($A/cm^2$) | 39 | 62 | 134 | 233 |

What is claimed is:

1. A vacuum diode, for the detection of electromagnetic radiation (2), this diode comprising:

a photo-cathode (4) intended to receive the radiation, and a grid (6) positioned facing the photo-cathode and spaced apart from it, intended to collect the electrons emitted by the photo-cathode when the photo-cathode receives the radiation, this diode being characterized in that the grid (6) has the shape of a cylinder and surrounds the photo-cathode (4), the latter extending along the axis (X) of the cylinder, in that the photo-cathode comprises a part (4) of the internal conductor (10) of a coaxial cable (8), the external conductor and the electrically insulating material (14) of this coaxial cable being removed opposite this part, and in that the grid (6) is electrically connected to the external conductor (12) of this coaxial cable, the internal and external conductors being coaxial.

2. A diode according to claim 1, characterized in that said part (4) is an end of the internal conductor (10) of the coaxial cable (8).

3. A diode according to claim 1, characterized in that the internal radius of the grid (6) is about equal to the internal radius ($R_1$) of the external conductor (12) of the coaxial cable (8).

4. A diode according to claim 1, characterized in that the internal radius of the grid is chosen in such a way that the impedance of the diode when it is placed under vacuum, is equal to the surge impedance of the coaxial cable (8).

* * * * *